United States Patent [19]

Suzuki et al.

[11] Patent Number: 4,501,590

[45] Date of Patent: Feb. 26, 1985

[54] INSTANT THREAD DYEING METHOD FOR SEWING MACHINES

[75] Inventors: Ryoichi Suzuki; Yoshio Yamaguchi, both of Tokyo, Japan

[73] Assignee: Janome Sewing Machine Industry Co., Ltd., Japan

[21] Appl. No.: 507,411

[22] Filed: Jun. 24, 1983

[30] Foreign Application Priority Data

Jun. 25, 1982 [JP] Japan ..... 57-108497

[51] Int. Cl.[3] ..... D06P 5/02

[52] U.S. Cl. ..... 8/495; 8/558; 8/637

[58] Field of Search ..... 8/558, 495, 637

[56] References Cited

U.S. PATENT DOCUMENTS 3,711,316 1/1973 Angliss et al. ..... 8/127.6

4,239,868 12/1980 Bonnet et al. ..... 525/279

*Primary Examiner*—A. Lionel Clingman

*Attorney, Agent, or Firm*—William A. Drucker

[57] ABSTRACT

The invention provides a method for instantly dyeing a sewing machine thread without necessity of interrupting the stitching operation with a sewing machine. The method is implemented with a dyeing liquid consisting of 2–15 wt. % of a water color paste, 15–30 wt. % of an acrylic ester emulsion and the reminder water, the dyeing liquid being uniformly applied to the thread by way of sponge or felt. The thread is then brought into contact with a plate heated to a temperature of 180°–240° C. for 1–3 seconds for permanent set of the dyeing liquid on the thread.

6 Claims, No Drawings

INSTANT THREAD DYEING METHOD FOR SEWING MACHINES

BACKGROUND OF THE INVENTION

The invention relates to an instant thread dyeing method for sewing machines, and more particularly to a method for succesively and instantly dyeing a sewing machine thread with different colors as desired while the thread is used with a sewing machine in a stitching operation.

So far, it has been necessary to prepare so many threads of different colors as required to use for a stitching operation, especially for making pattern stitches and embroidery stitches with a sewing machine, and to selectively use these threads of different colors in dependence upon the kind of pattern stitches or embroidery stitches required. If the sewing machine operator desires to employ a complicated and colorful embroidery stitching with many differently colored threads according to such a conventional manner, the operator is required to interrupt the stitching operation in order to change the sewing machine thread each time a different colored thread is to be used. Such a thread changing operation is considerably troublesome and time-consuming.

Therefore, many attempts have been made for providing a method for dyeing a white or colorless thread with any given color without interrupting the stitching operation. However, there have actually been many difficulties in attaining such a method which will have to satisfy all of the following requirements:

(a) The thread dyeing treatment must be carried out so quickly as to cover a thread consumption speed (i.e., about 1–15 cm/sec) during the stitching operation with a sewing machine;

(b) The thread dyeing treatment will not deteriorate the characteristics of the thread such as slideability and flexibility;

(c) The dyeing effect will be perfect;

(d) The dyeing treatment may be adapted to any kind of thread with any given color; and (e) The thread dyeing device for carrying out the method must be simple and compact in structure and easy to use.

SUMMARY OF THE INVENTION

It is therefore an object of the invention to provide a novel method for instantly dyeing a thread with a desired color, while locating the thread on a sewing machine and driving the sewing machine for a stitching operation.

Another object of the invention is to provide a method for instantly dyeing a thread used for a stitching operation with a sewing machine, which method satisfies all of the aforementioned requirements (a) through (e).

Accordingly there is provided, in accordance with the invention, a method for dyeing a sewing machine thread comprising the steps of preparing a dyeing liquid consisting of 2–15 wt.% of a water color paste containing 20–40 wt.% of a pigment, 15–30 wt.% of an acrylic ester emulsion containing 30–40 wt.% of a resin component, and the remainder water; uniformly applying the dyeing liquid to the thread; bringing the thread into contact with a hot plate heated to a temperature of 180°–240° C. for 1–3 seconds, thereby drying and setting the dyeing liquid on the thread; and successively supplying the colored thread for a stitching operation with a sewing machine.

DETAILED DESCRIPTION OF THE INVENTION

We have made many experiments on different conditions with respect to the thread dyeing method, as the result of which it is found that all of the requirements (a) through (e) can be fully satisfied by the method as described below.

(1) Dyeing Liquid

A dyeing liquid used in the method of the invention consists of 2–15 wt.% of a water color paste containing 20–40 wt.% of a pigment of a desired color, 10–30 wt.% of an acrylic ester emulsion containing 30–40 wt.% of a resin component and the reminder water.

The pigment of water color paste may be of any type, inorganic or organic. The inorganic pigment may be ultramarine blue, Berlin blue (iron blue), chrome yellow, titanium oxide (white) and carbon black. The organic pigment may be copper phthalocyanine (blue or green), quinacridone (red), alizarin (various colors) and benzidine (yellow). From these compositions, alone or in combination, are prepared many pigments of pressed cakes of different colors, which are then kneaded with a nonionic surface active agent of HLB (hydrophilic-lipophilic balance) 12–18 and a protective colloidal agent such as starch and gelatin. The resulting mixture is dissolved and dispersed in water to prepare the water color paste. In this connection, it has been found advantageous that the water color paste contains 20–40 wt.% of pigment, 5–10 wt.% of nonionic surface active agent and 1–3 wt.% of protective colloidal agent. The particle diameter of pigment should be 5$\mu$ or less. A pigment of larger particle diameter, when applied to the sewing machine thread, would lower the slideability and flexibility of the thread due to the frictional resistance and may cause sewing problems.

Further, according to the dyeing method of the invention, a resin is used as a binder for securely applying the pigment to the thread. In this respect, our experiments have revealed that it is desirable to use an acrylic ester emulsion as such a resin. Especially satisfactory results were obtained when using a copolymerized acrylic ester emulsion consisting of 2–5 wt.% of acrylic methyl, 5–20 wt.% of n-acrylic butyl and the reminder acrylic ethyl and containing resin component of 30–40 wt.%. When using such an acrylic ester emulsion, the pigment was well adhered to the thread without degrading the flexibility as well as the slideability of the thread and the colored thread showed a satisfactory degree of finished effect, namely the pigment adhered to the thread would not peel off, even when the thread was subjected to washing or dry-cleaning.

The composition of water color paste and acrylic ester emulsion in the dyeing liquid are 2–15 wt.% and 10–30 wt.% (preferably about 15 wt.%) respectively, which was found most desirable in view of providing a most preferred shade of color and a most solid adherance of the pigment. Inclination of the balance in one way or other would adversely affect the preferred shade of color and solid adherance of the pigment.

(2) Application of Dyeing Liquid to Thread

It is of course necessary to apply the dyeing liquid uniformly to the thread. Moreover, in order to carry out the thread dyeing treatment during the stitching operation, it is absolutely required that the thread dyeing operation must not apply a tension to the thread. For these reasons, it is preferable to pass the thread in a predetermined direction while it is held in contact with a porous material soaked with the dyeing liquid. Especially, it is desirable to contact the thread with a brush or felt-pen soaked with the dyeing liquid which is supplied from a dyeing liquid cartridge detachably contained in a holder.

(3) Permanent Set of Dyeing Liquid on Thread

The dyeing liquid which has been thus applied to the thread must be dried quickly so as to successively supply the colored thread at a speed corresponding to the thread consumption speed in the stitching operation. For this purpose, it has been found most preferably to bring the thread into contact with a hot plate heated to a temperature of 180°-240° C. for 1—3 seconds. More particularly, the thread consumption speed (or amount per second) differs in dependence upon the rotation speed of sewing machine, for example a household sewing machine is operated approximately up to 1200 r.p.m. whereas an industrial sewing machine is operated approximately up to 5000 r.p.m. It is thus necessary to maintain the predetermined heating time and temperature to dry up the dyed thread, irrespective of the operation speed of the sewing machine.

For preventing the thread from being tightened during the drying treatment, the hot plate may be provided with a face curved to preferably have a curvature radius of 300 mm or more. Moreover, the plate should preferably have been subjected to a surface treatment, for example, ceramic-coating, Teflon-coating and chrome-plating, to reduce the friction which may be applied to the passing thread and to prevent the plate from being polluted with the dyeing liquid.

In accordance with the method of the invention carried out on the above-described conditions, irrespective of kind of the thread; nylon, polyester, rayon or silk, it was possible to produce a well-colored thread and stitch a colorful design with a sewing machine by successively supplying the colored thread without interrupting the stitching operation.

What we claim is:

1. A method for dyeing a continuously supplied sewing machine thread comprising the steps of:

(a) preparing a coloring liquid consisting of 2-15 wt.% of a coloring paste containing 20-40 wt.% of a pigment formed of particles having a diameter not more than 5 microns, 15-30 wt.% of an emulsion containing 30-40 wt.% of an acrylic resin, and the remainder water;

(b) providing a continuously supplied sewing machine thread, (c) uniformly applying said coloring liquid to said thread;

(d) bringing said thread into contact with a hot plate heated to a temperature of 180°-240° C. for 1-3 seconds, thereby drying and setting said coloring liquid on said thread; and (e) successively supplying the colored thread for a stitching operation with a sewing machine.

2. The method of claim 1 wherein said coloring paste consists of 20-40 wt.% of a pigment, 5-10 wt.% of a nonionic surface active agent of HLB 12-18, 1-3 wt.% of a protective colloidal agent and the remainder water.

3. The method of claim 1 wherein said acrylic ester emulsion consists of 2-5 wt.% of methyl acrylate, 5-20 wt.% of n-butyl acrylate and the remainder ethyl acrylate.

4. The method of claim 1 wherein said coloring liquid is applied to said thread by moving said thread in a predetermined direction while being held in contact with a porous material soaked with said dyeing liquid.

5. The method of claim 1 wherein said hot plate is curved to have a curvature radius of 300 mm or more.

6. The method of claim 1 wherein said plate has been subjected to a surface treatment to reduce the friction which may be applied to said thread as said thread is moved on said plate.

* * * * *